US006054807A

United States Patent [19]

Carpenter

[11] Patent Number: 6,054,807

[45] **Date of Patent: *Apr. 25, 2000**

[54] PLANARIZED BASE ASSEMBLY AND FLAT PANEL DISPLAY DEVICE USING THE PLANARIZED BASE ASSEMBLY

[75] Inventor: Craig M. Carpenter, Boise, Id.

[73] Assignee: Micron Display Technology, Inc., Boise, Id.

[ * ] Notice: This patent issued on a continued prosecution application filed under 37 CFR 1.53(d), and is subject to the twenty year patent term provisions of 35 U.S.C. 154(a)(2).

[21] Appl. No.: 08/742,667

[22] Filed: Nov. 5, 1996

[51] Int. Cl.[7] ..... H01J 1/62; H01J 63/04; H01J 1/02; H01J 1/16

[52] U.S. Cl. ..... 313/495; 313/309; 313/336; 313/351

[58] Field of Search ..... 313/309, 310, 313/336, 357, 495, 497; 445/50, 51

[56] References Cited

U.S. PATENT DOCUMENTS 5,151,061 9/1992 Sandhu .
5,186,670 2/1993 Doan et al. .
5,205,770 4/1993 Lowrey et al. .
5,232,549 8/1993 Cathey et al. .
5,232,875 8/1993 Tuttle et al. .
5,330,879 7/1994 Dennison .
5,357,172 10/1994 Lee et al. .
5,358,908 10/1994 Reinberg et al. .
5,372,973 12/1994 Doan et al. .
5,387,844 2/1995 Browning .
5,391,259 2/1995 Cathey et al. .
5,394,006 2/1995 Liu ..... 313/336 X
5,410,218 4/1995 Hush .
5,438,240 8/1995 Cathey et al. .
5,438,259 8/1995 Orihashi et al. .
5,459,480 10/1995 Browning et al. .
5,484,314 1/1996 Farnworth .
5,486,126 1/1996 Cathey et al. .
5,786,659 7/1998 Takagi et al. ..... 313/310 X

*Primary Examiner*—Michael H. Day
*Assistant Examiner*—Mack Haynes
*Attorney, Agent, or Firm*—Nixon & Vanderhye P.C.

[57] ABSTRACT

A base structure for use with a flat panel field emission display device. A spacer layer is provided in the base assembly to generally planarize the base assembly prior to mechanical planarization. As a result, the base assembly is more reliable and permits improved manufacturing yields. In addition to improving planarity of the base assembly, the spacer layer may increase electrical isolation between the base electrodes and the grid electrodes of the field emission display.

34 Claims, 6 Drawing Sheets

PLANARIZED BASE ASSEMBLY AND FLAT PANEL DISPLAY DEVICE USING THE PLANARIZED BASE ASSEMBLY

STATEMENT OF GOVERNMENT INTEREST

This invention was made with Government support under Contract No. DABT63-93-C-0025 awarded by Advanced Research Projects Agency (ARPA). The Government has certain rights in this invention.

BACKGROUND OF THE INVENTION

The present invention relates to an improved base assembly which may be used in flat panel displays. More particularly, the present invention relates to highly planar base assemblies used in flat panel field emission displays, and techniques for producing such base electrodes.

Known techniques for manufacturing field emission displays (FEDs) may utilize a process known as chemical-mechanical planarization (CMP), which is also sometimes referred to as chemical-mechanical polishing. The use of a chemical-mechanical planarization process in manufacturing a field emission display as disclosed, for example, in commonly owned U.S. Pat. No. 5,186,670 issued Feb. 16, 1993 to Doan et al. and U.S. Pat. No. 5,372,973 issued Dec. 13, 1994 to Doan et al. Further details of a chemical-mechanical planarization process are disclosed, for example, in commonly-owned U.S. Pat. No. 5,232,875 issued Aug. 3, 1993 to Tuttle et al. These patents are hereby incorporated by reference in their entirety.

A typical chemical-mechanical planarization process utilizes a polishing pad which planarizes an underlying work piece such as a semiconductor wafer by mechanical force. A chemically active slurry which carries an abrasive element may be utilized in conjunction with the polishing pad to improve the polishing performance. However, other mechanical planarization techniques may utilize an abrasive element carried directly in the polishing pad rather than in the slurry. Additionally, mechanical planarization techniques may utilize fluids which do not include a chemically active component.

Certain situations previously encountered in the manufacture of flat panel field emission displays with a mechanical planarization step presented difficulties. For example, if the structure of the underlying work piece is not sufficiently planar prior to polishing, the mechanical planarization step may have a tendency to round off comers of features on the field emission display base assembly or, possibly, to unintentionally penetrate completely through a layer of the field emission display base assembly. If a mechanical planarization step is used on an excessively non-planar work piece, problems may arise, for example, with oxide dielectric layers. Mechanical stress from the planarization of a non-planar workpiece may cause damage to dielectric layers, leading to possible dielectric breakdown. Problems can also arise with conductive layers, particularly if conductors are severed or if leakage pads are formed. All of this, of course, adversely impacts on the quality of the resultant field emission display and may require portions of a production lot to be scrapped. As a result, production yields are reduced and manufacturing expenses increased.

Accordingly, there is a need for a base assembly for use with a flat panel field emission display which permits improved results from a mechanical planarization step such as chemical-mechanical planarization. It is a primary objective of the present invention to provide such a base assembly, and a technique for producing such a base assembly.

BRIEF SUMMARY OF THE INVENTION

In accordance with one aspect of the present invention, an improved base assembly is obtained by providing an insulative spacer layer which reduces surface irregularities prior to a mechanical planarization operation.

The preferred embodiment provides a first conductive layer over first portions of a base. The first conductive layer preferably forms an addressable matrix of electrodes. A resistive layer is formed over second portions of the base, wherein the second portions overlap the first portions at least in part. A first insulative layer is formed over third portions of the base and has a thickness which generally corresponds to the average thickness of the resistive layer. The first insulative layer is substantially non-overlapping relative to the resistive layer, and acts as a spacer to help planarize the base assembly. A second insulative layer is then formed over the entire base assembly.

An array of field emitters is preferably provided over the resistive layer to form the micro-cathodes for a field emission display. Additionally, a second conductive layer which may be provided over the second insulative layer to operate as a grid electrode.

A field emission display in accordance with the present invention may include a base on which an addressable conductor array is formed. A plurality of field emitter tips is separated from corresponding portions of the conductor array by a pattern of resistive material. A spacer is formed in a pattern adjacent the pattern of resistive material to fill openings in that pattern. The spacer preferably has a top surface which generally coincides with the top surface of the resistive material. An insulating layer is provided over the spacer, resistive material and field emitters, and a conductive material which may act as a grid electrode is formed over the insulating layer. A phosphor coated screen is spaced from the conductive material.

In accordance with yet another aspect of the present invention, a method is provided for producing a substantially planar base assembly. A preferred method forms a pattern of conductive material and an overlapping pattern of resistive material over a base. A first layer of insulating material is deposited over the conductive material and the resistive material, and a photoresist pattern is provided over the first layer of insulating material. The photoresist pattern is preferably a substantial complement to the pattern of the resistive material. A subsequent etch operation removes the portion so the first layer of insulating material which lies over the resistive material pattern. The photoresist is then removed and a second layer of insulative material is deposited. Additionally, a second pattern of conductive material may be provided over the second layer of insulative material. Thereafter, a mechanical planarization step such as chemical-mechanical planarization may be performed.

BRIEF DESCRIPTION OF THE DRAWINGS

The objects, features, advantages and characteristics of the present invention will become apparent from the following detailed description of preferred embodiment, when read in view of the accompanying drawings, wherein.

DETAILED DESCRIPTION OF EXEMPLARY EMBODIMENTS

The present invention is described in the context of exemplary embodiments. However, the scope of the invention is not limited to the particular examples described in the specification. Rather, the description merely reflects what are currently considered to be the most practical and preferred embodiments, and serves to illustrate the principles and characteristics of the present invention. Those skilled in the art will recognize that various modifications and refinements may be made without departing from the spirit and scope of the invention.

Figure 1:
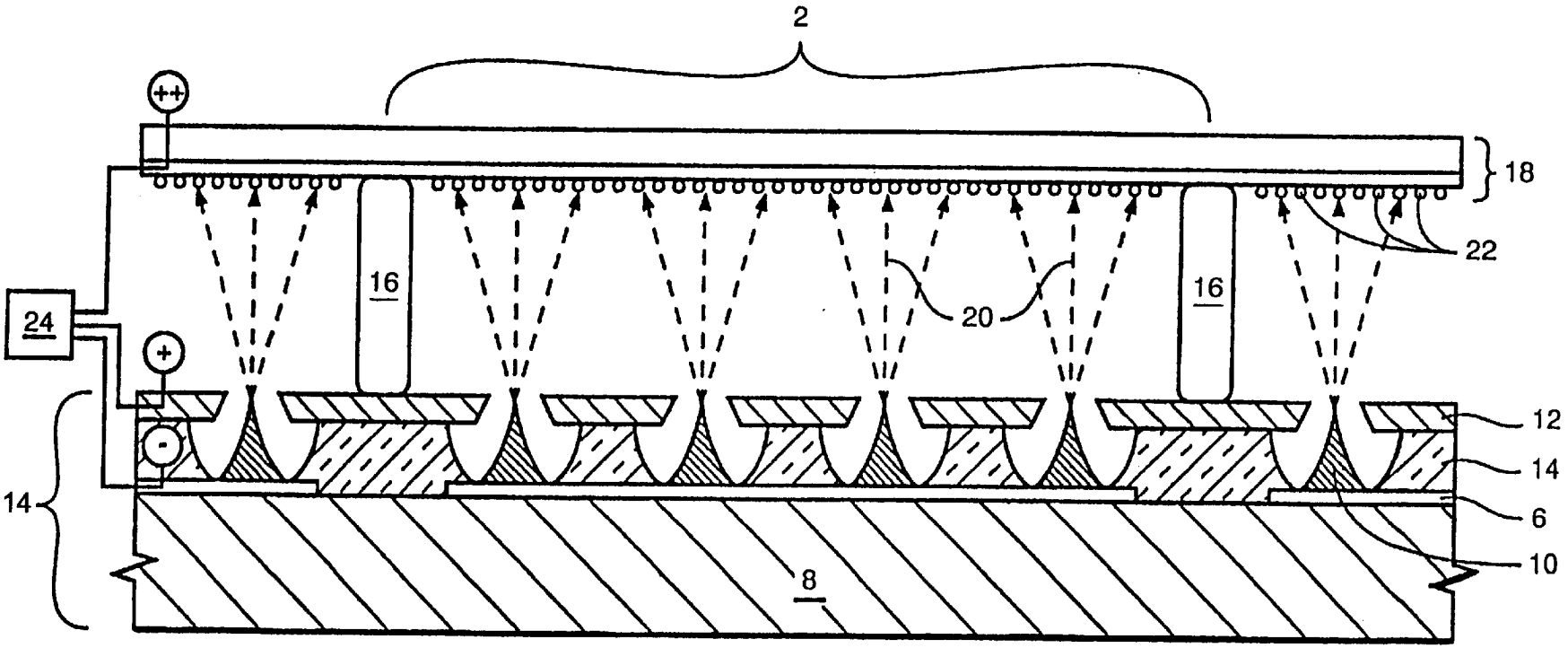
FIG. 1 is an illustrative cross-sectional schematic drawing of a flat panel field emission display.

FIG. 1 is a cross-sectional schematic of a portion of a flat panel field emission display. In particular, a single display segment 2 is depicted. Each display segment is capable of displaying a pixel of information or a portion of a pixel as, for example, one green dot of red/green/blue full-color triad pixel. A field emission display base assembly 4 includes a patterned conductive material layer 6 provided on a base 8 such as a soda lime glass substrate. The conductive material layer 6 may be formed, for example, from doped polycrystalline silicon and/or an appropriate conductive metal such as chromium. The conductive material layer 6 forms base electrodes and conductors for the field emission device.

Conical micro-cathode field emitter tips 10 are constructed over the base 8 at the field emission cathode site. In a preferred embodiment, a base electrode resistive layer (not shown in FIG. 1) may be provided between the conductive material layer 6 and the field emitter tips 10. The resistive layer may be formed, for example, from silicon which has been doped to provide an appropriate degree of resistance. A low potential anode gate structure or conductive grid 12 formed, for example, of doped polycrystalline silicon is arranged adjacent the field emitters 10. An insulating layer 14 separates the grid 12 from the base electrode conductive material layer 6. The insulating layer 14 may be formed, for example, from silicon dioxide.

Proper functioning of the emitter tips requires operation in a vacuum. Thus, a plurality of columnar supports 16 are provided over the base assembly 4 to support a display screen 18 against atmospheric pressure. The columnar supports 16 may be formed in a number of conventional ways. Appropriate techniques for forming the columnar supports 16 are disclosed, for example, in U.S. Pat. No. 5,205,770 issued Apr. 27, 1993 to Lowrey et al., U.S. Pat. No. 5,232,549 issued Aug. 3, 1993 to Cathey at al., U.S. Pat. No. 5,484,314 issued Jan. 16, 1996 to Farnworth, and U.S. Pat. No. 5,486,126 issued Jan. 23, 1996. These patents are hereby incorporated by reference in their entirety.

In operation, the display screen 18 acts as an anode so that field emissions from the emitter tips 10, represented by arrows 20, strike phosphor coating 22 on the screen 18. The field emissions excite the phosphor coatings 22 to generate light. A field emission is produced from an emitter tip when a voltage controller 24 establishes a voltage differential between the emitter tip and the anode structures.

Various techniques are known in the art for allowing selectable activation of a display segment. For example, the grid 12 and screen 18 could be held at a constant voltage potential and emitter tips selectively switched through column and row signals. In such an arrangement, the patterned conductive material 6 which forms the cathode base electrodes is arranged as a matrix that is addressable through column and row control signals. Alternatively, the base electrode conductors could be arranged in rows and the grid 12 arranged in columns perpendicular to the rows of cathode base electrodes. Row control address signals to the cathode base electrodes and column control address signals to the grid column segments selectably activate display segments. Finally, the cathodes could be held at a constant voltage potential and a switched anode scheme utilized for the display screen 18.

Figure 2:
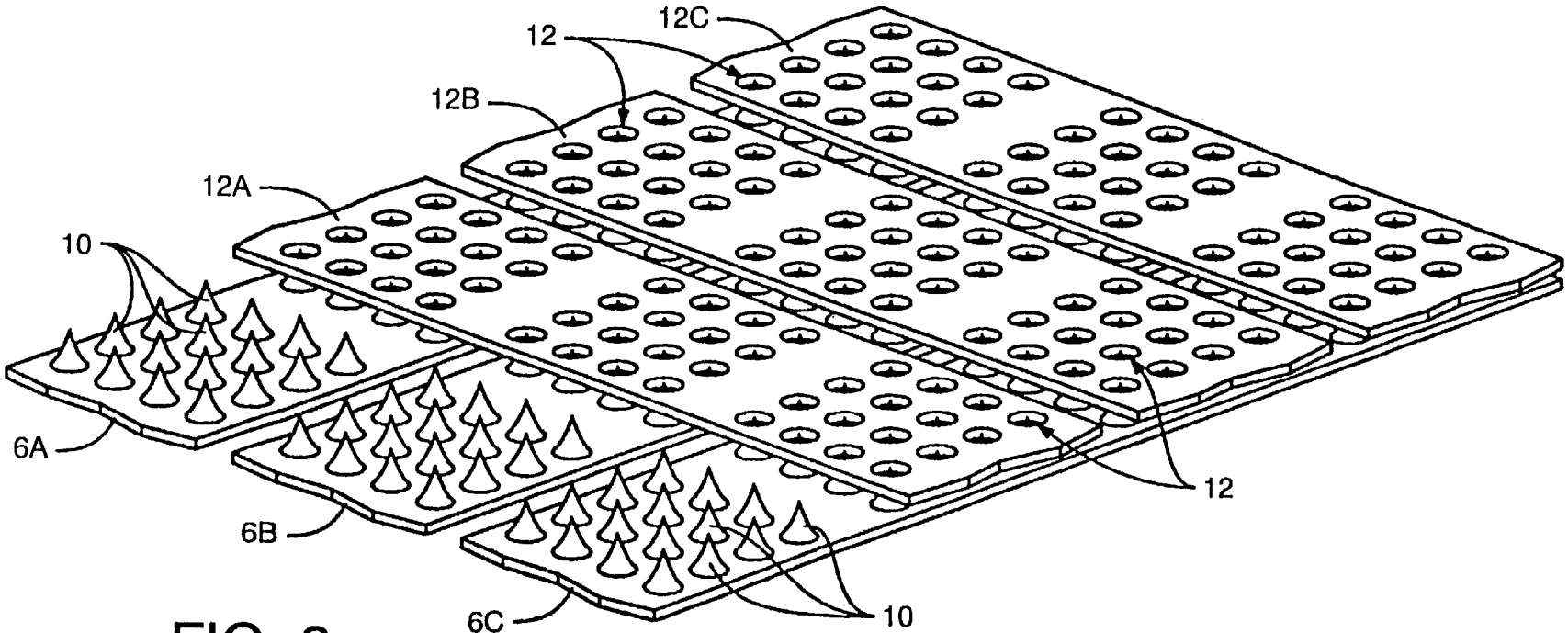
FIG. 2 is a simplified perspective view of a conventional grid and emitter base electrode structure in a flat panel field emission display.

Turning now to FIG. 2, in one example the conductive material layer 6 may include a series of rows 6A, 6B and 6C, and the grid electrode 12 may include a series of columns 12A, 12B and 12C. It should be appreciated that FIG. 2 is merely illustrative and, in practice, many more rows and columns would typically be provided for a display screen. Each picture segment in this example includes a 4×4 group of micro-cathodes 10. The redundancy in cathodes improves picture resolution and enhances product reliability and manufacturing yield.

To drive a particular picture segment, the controller selects a conductive material layer row (row 6C for example) and a grid electrode column (column 12A for example) and connects them respectively to appropriate voltage potentials. In this way, the picture segment corresponding to the cathodes located at the intersection of row 6C and column 12*a* will be activated. Suitable pixelator drive circuitry for the rows and columns is known in the art and is disclosed, for example, in commonly-owned U.S. Pat. No. 5,438,240, issued Aug. 1, 1995 to Cathey et al., and U.S. Pat. No. 5,410,218, issued Apr. 25, 1995 to Hush, which are hereby incorporated by reference in their entirety.

As previously noted, in a different arrangement the conductive material 6 which forms the base electrodes may form a matrix of addressable nodes and provide for both row and column controls for addressing the field emitters. In such an arrangement, the patterned conductive material layer 6 preferably provides a matrix of base electrodes 6' under the individual picture segments. The conductive grid 12 is preferably continuous throughout the entire display and is maintained at a constant potential $V_{GRID}$. Drive circuits for use with such an arrangement are disclosed, for example, in commonly-owned U.S. Pat. No. 5,357,172, issued Oct. 18, 1994 to Lee et al, U.S. Pat. No. 5,387,844, issued Feb. 7, 1995 to Browning, and U.S. Pat. No. 5,459,480, issued Oct. 17, 1995, to Browning et al. These patents are hereby incorporated by reference in their entirety.

Figure 3A:
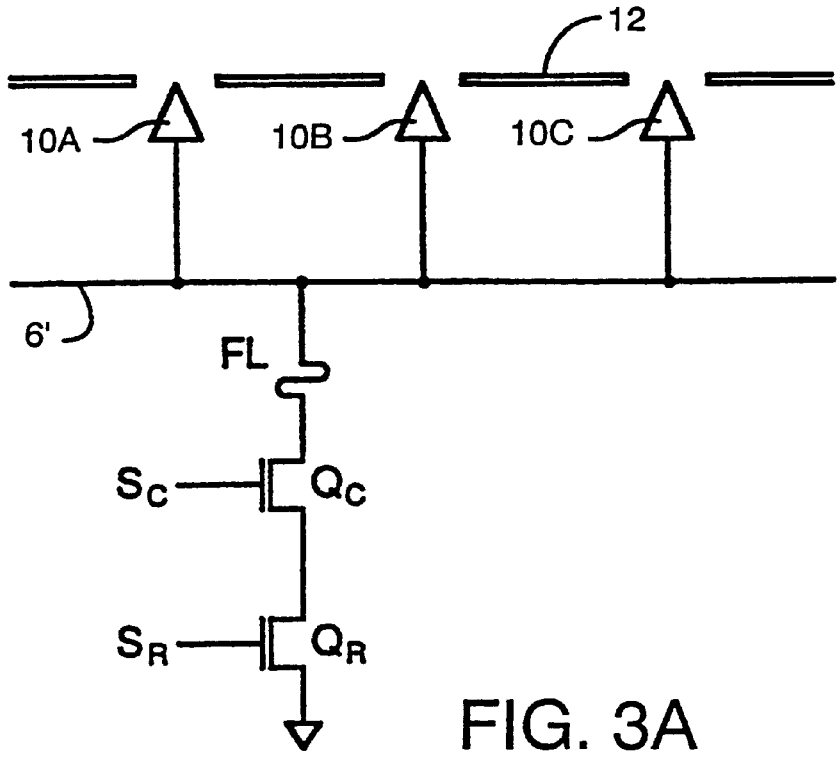
FIG. 3A illustrates a drive circuit for a flat panel field emission display which utilizes an alternative grid and emitter base electrode structure.

A single emitter node is illustrated in FIG. 3A. Although the example emitter node depicted by FIG. 2 has only three field emitter tips (10A, 10B, 10C), the actual number may be much higher. Each of the emitter tips 10 is electrically coupled to a base electrode 6' that is common to only the emitters of a single emitter node. To induce field emission, base electrode 6' may be operated in a pull-down node. In the preferred embodiment, the base electrode 6' is maintained at ground potential through a pair of series-coupled field-effect transistors $Q_C$ and $Q_R$. Transistor $Q_C$ is gated by a column line control signal $S_C$ from controller 24, while transistor $Q_R$ is gated by a row line control signal $S_R$. When one of the transistors $Q_C$ and $Q_R$ is switched OFF, electrons continue to be discharged form the corresponding emitter tips until the voltage differential between the base electrode 6' and the grid 12 drops below the emission threshold voltage. At that point, the display segment is turned OFF.

Figure 3B:
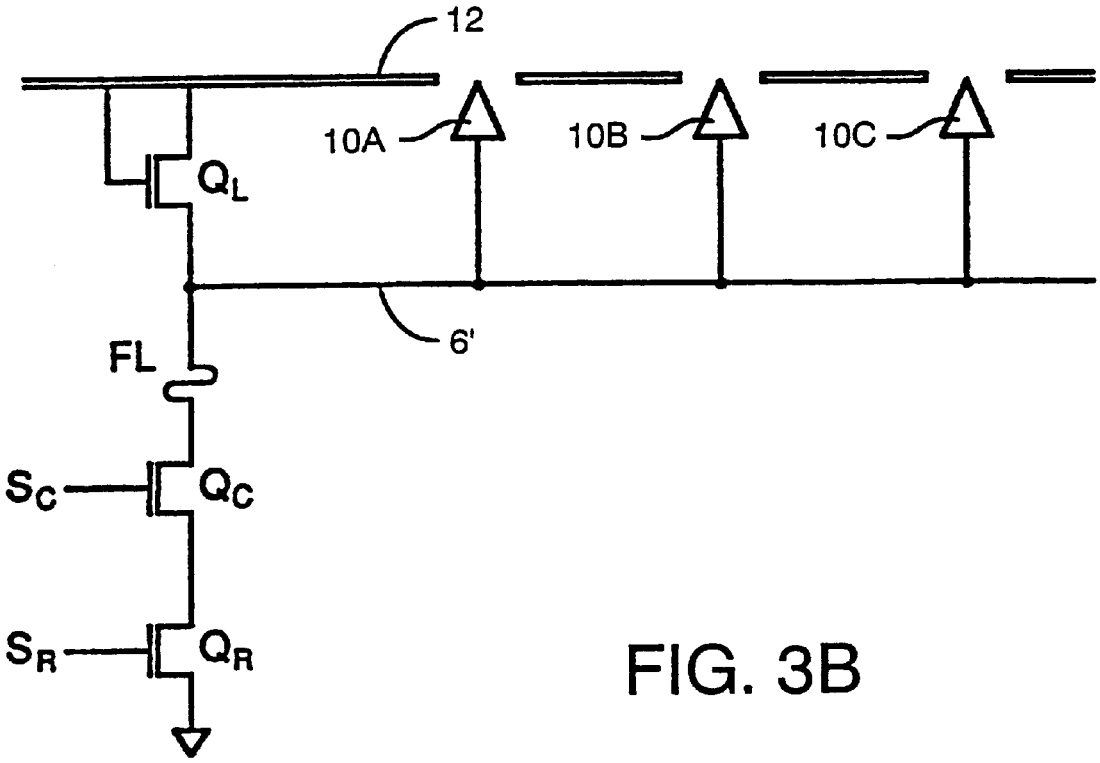
FIG. 3B illustrates a modification of the drive circuit of FIG. 3A.

FIG. 3B illustrates a modification of the arrangement of FIG. 3A, wherein a current limiting field effect transistor $Q_L$ having a threshold voltage $V_T$ has been added. Both the drain and gate of transistor $Q_L$ are directly coupled to grid 12. The channel transistor $Q_L$ is sized such that current is limited to a minimal amplitude necessary to restore base electrode 6' and associated emitters 10A, 10B and 10C, to a potential that is substantially equal to $V_{GRID}-V_T$ at a rate sufficient to ensure adequate gray scale resolution.

A fusible link FL may be provided in the arrangements of FIGS. 3A and 3B. The fusible link FL may be blown during testing if a base-to-emitter short is detected within that emitter group, thus isolating the shorted group from the remainder of the array to improve yields and to minimize array power consumption.

Figure 3C:
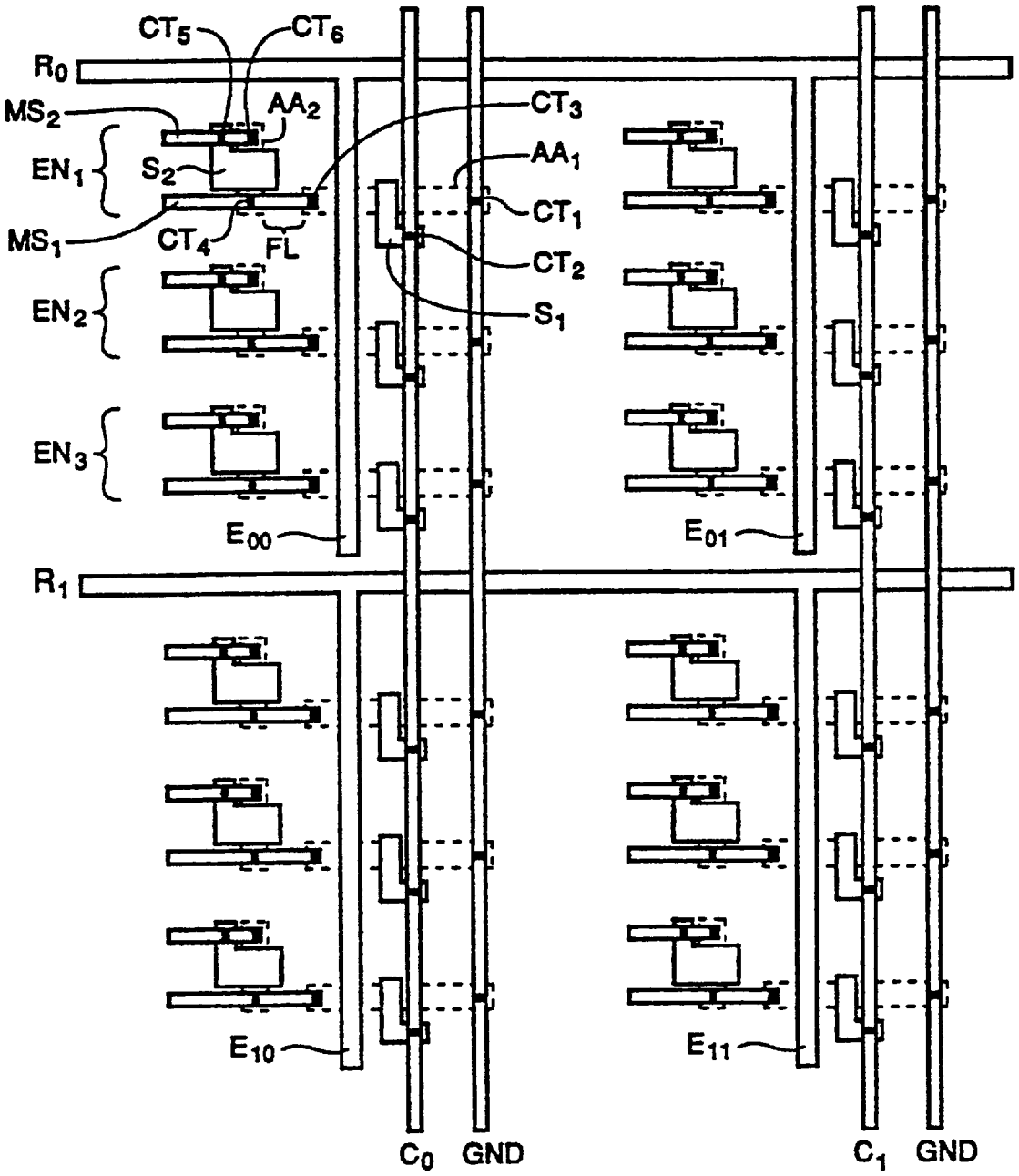
FIG. 3C is a top plan view of a layout for a flat panel field emission display architecture in which the drive circuits of FIGS. 3A or 3B may be used.

Referring now to FIG. 3C, a simplified layout is depicted which provides for multiple emitter nodes for each row-column intersection of the display array. The conductive material layer 6 includes a pair of doped polycrystalline silicon row lines $R_0$ and $R_1$ which orthogonally intersect metal column lines $C_0$ and $C_1$ and a pair of metal ground lines $GND_0$ and $GND_1$. Ground line $GND_0$ is associated with column line $C_0$, while ground line $GND_1$ is associated with column line $C_1$. For each row and column intersection, there is at least one row line extension, which forms the gates and gate interconnects for multiple emitter nodes within that pixel. For example, extension $E_{00}$ is associated with the intersection of row $R_0$ and column $C_0$; extension $E_{01}$ is associated with the intersection of row $R_0$ and column $C_1$; extension $E_{10}$ is associated with the intersection of row $R_1$ and column $C_0$; and extension $E_{11}$ is associated with the intersection of row $R_1$ and column $C_1$. As all intersections function in an identical manner, only the components with the $R_0$-$C_0$ intersection region will be described in detail.

Three emitter nodes, $EN_1$, $EN_2$ and $EN_3$, are supported by the $R_0$-$C_0$ intersection region. Each emitter node comprises a first active area $AA_1$ and a second active area $AA_2$. A metal ground line GND makes contact to one end of first active area Al at first contact $CT_1$. In combination with first active area $AA_1$, a first L-shaped doped polycrystalline silicon strip S1 forms the gate of field-effect transistor $Q_C$ (see FIGS. 3A and 3B). Metal column line $C_0$ makes contact to doped polycrystalline silicon strip $G_1$ at second contact $CT_2$. Doped polycrystalline silicon extension $E_{00}$ forms the gate of field-effect transistor $Q_R$ (see FIGS. 3A and 3B). A first metal strip $MS_1$ interconnects first active area $AA_1$, and second active area $AA_2$, making contact at third contact $CT_3$ and fourth contact $CT_4$, respectively. The portion of metal strip $MS_1$ between third contact $CT_3$ and fourth contact $CT_4$ forms fusible link FL. The emitter base electrode 6' (not shown in FIG. 3C, see item 6' in FIGS. 3A and 3B) is coupled to metal strip $MS_1$. A second L-shaped doped polycrystalline silicon strip $S_2$ forms the gate of current limiting transistor $Q_{CL}$, and a second metal strip $MS_2$ is connected to second doped polycrystalline silicon strip $S_2$ at fifth contact $CT_5$, and to second active area $AA_2$ at sixth contact $CT_6$. The grid plate (not shown in FIG. 3C, see FIGS. 3A and 3B) is connected to second metal strip $MS_2$. Of course, other conductive materials may be substituted for the doped polycrystalline silicon and metal structures. For example, silicided polysilicon or molybdenum may be used.

Various techniques are known for producing structures such as those illustrated in FIGS. 1–3. For example, techniques for forming the conical cathode emitter tips are disclosed in commonly-owned U.S. Pat. No. 5,151,061, issued Sep. 29, 1992 to Sandhu, U.S. Pat. No. 5,330,879, issued Jul. 19, 1994 to Dennison, U.S. Pat. No. 5,358,908, issued Oct. 25, 1949 to Reinberg et al., U.S. Pat. No. 5,391,259, issued Feb. 21, 1995 to Cathey et al., and U.S. Pat. No. 5,438,259 issued Aug. 1, 1995 to Cathey et al. These patens are hereby incorporated by reference. In addition to the foregoing techniques, conventional methods such as the Spindt process for producing conical field emitters are well-known in the art.

As noted above, overall techniques for producing the base assembly are known from the Doan et al. U.S. Pat. Nos. 5,186,670 and 5,372,973. The techniques disclosed in those patents utilize a mechanical planarization technique such as chemical-mechanical planarization following creation of the layers which make up the base assembly. As noted above, such mechanical planarization techniques can sometimes produce undesirable results if the structure of the work piece on which it operates is excessively non-planar.

Figure 4:
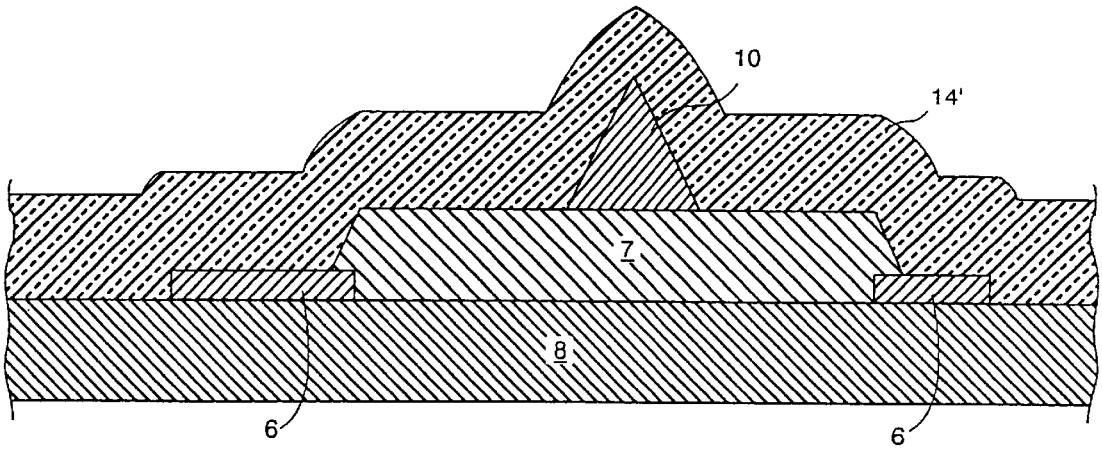
FIG. 4 illustrates the results of an intermediate step in the production of a base assembly for a flat panel field emission display in accordance with an exemplary implementation of the present invention.

In accordance with one aspect of the present invention, a base assembly is provided which avoids these drawbacks that might be encountered with a mechanical planarization technique. Referring now to FIG. 4, a patterned conductive material layer 6 such as chromium is deposited on a soda lime glass substrate 8 using a conventional technique. Because soda lime glass has a relatively low melting point, care should be taken to avoid any fabrication step in producing the base assembly that would require temperatures high enough to melt or soften the soda lime glass. As an example, the highest temperature encountered in the production of the base assembly might be approximately 300° C., which can be reached during production of the cold cathode surfaces. Typical temperatures encountered during packaging might approach approximately 480° C.

In the exemplary embodiment, the conductive material layer 6 provides the base electrodes for the field emitter tips 10. For convenience, only a single field emitter tip is illustrated. A base electrode resistive layer 7 is preferably provided between the base electrodes and the corresponding field emitter tips to limit the device current. The resistive layer may be formed, for example, of silicon doped to an appropriate resistivity using conventional techniques. A typical average thickness for the resistive layer 7 is approximately 7 K Å.

As illustrated in FIG. 4, the conductive layer is provided at the outer periphery of the resistive layer 7. As a result, the base electrode resistor operates as a lateral resistor wherein current flow is primarily lateral. This reduces problems associated with pinhole shorts through the resistive layer. Of course, a vertical resistor could likewise be provided, in which case the field emitter tips would be aligned vertically over the base electrodes.

Following formation of the resistive layer 7, the field emitters 10 are preferably formed utilizing a technique such as is disclosed in the aforementioned commonly-owned patents. Thereafter, a first insulative layer 14' such as silicon dioxide is deposited over the conductive layer 6, the resistive layer 7 and the field emitter tips 10. A conventional deposition process such as chemical vapor deposition (CVD) may be used to deposit the insulative layer 14'. The thickness of the insulative layer 14' is controlled to approximate the average thickness of the resistive layer 7, e.g., approximately 7 K Å.

Figure 5:
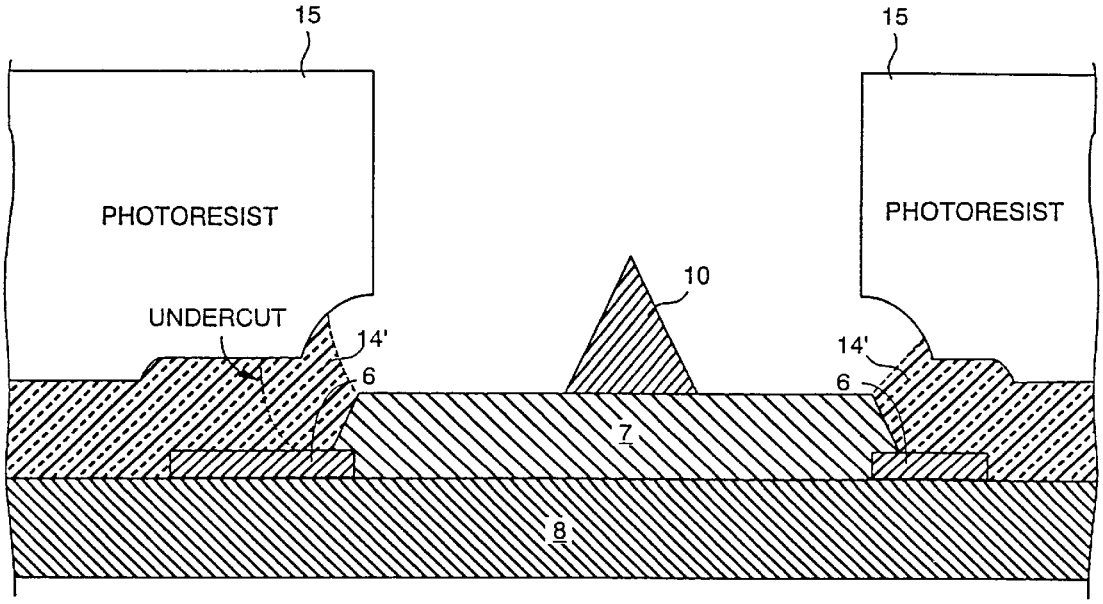
FIG. 5 illustrates the results of a subsequent intermediate step in the production of a base assembly for a flat panel field emission display in accordance with an exemplary implementation of the present invention.

Turning now to FIG. 5, a photoresist pattern 15 is formed on the first insulative layer 14' using standard photolithographic techniques. A wet etch is then applied to remove the portion of the first insulative layer over the resistive layer 7 and the field emitter tips 10. The photoresist is subsequently stripped, so that the remaining portions of the first insulative layer forms a spacer having a thickness roughly the same as the resistive layer thickness, e.g., approximately 7 K Å.

A wet etch operation is often difficult to control precisely. However, it is important to control the wet etch to prevent undercutting of the first insulative layer 14'. As shown in FIG. 5, an excessive undercut could expose the conductive layer 6, which can adversely affect the display. To guard against undercutting, the photoresist pattern preferably extends slightly over the edges of the resistive layer. An overlap of approximately 2 microns has been shown to be effective. Of course, the desired overlap may depend in part on the dimensions of the layers and patterns in the base assembly.

Following stripping of the photoresist material, a second insulative material layer 14, such as silicon dioxide is deposited. Preferably, a CVD process is used to deposit the second insulative layer to a thickness, for example, of 6 K Å. Subsequently, a conductive layer 12 such as doped polycrystalline silicon is formed over the insulative layer 14. The conductive layer 12 forms the grid electrode for the field emission display, and the insulative layer 14 electrically isolates the grid electrode from the base electrodes. Insulative spacer layer 14', in addition to planarizing the structure, provides additional electrical isolation between the base electrodes and the grid 12. Thus, the spacer layer 14' improves planarity of the base assembly and helps guard against pinhole short circuits and the like between the base electrodes and the grid electrode.

Figure 6:
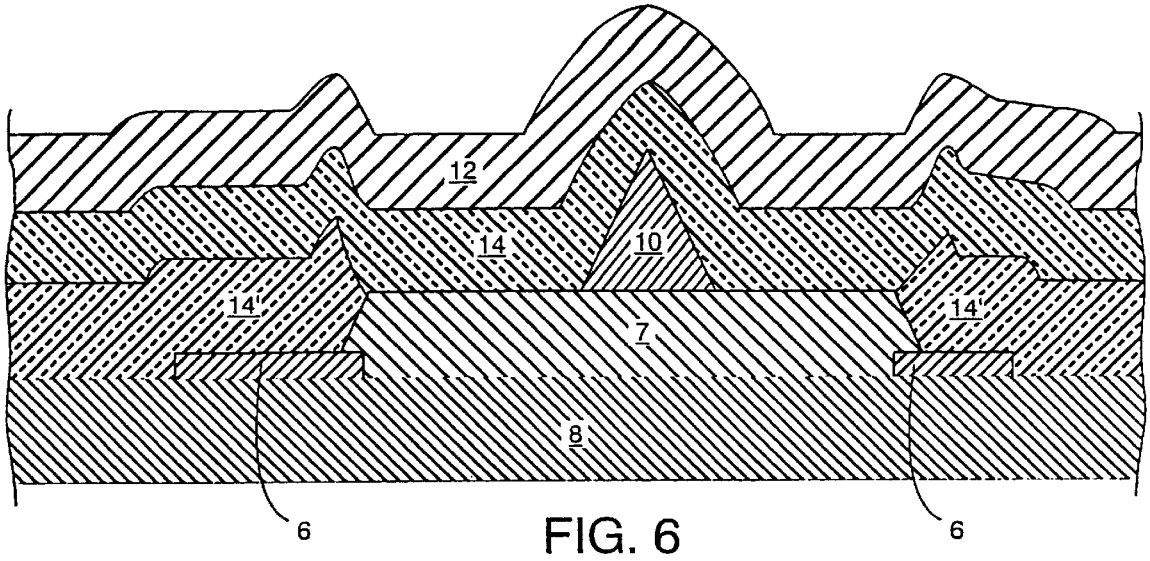
FIG. 6 illustrates the results of yet a further step in the production of a base assembly for a flat panel field emission display in accordance with an exemplary implementation of the present invention.
Figure 7:
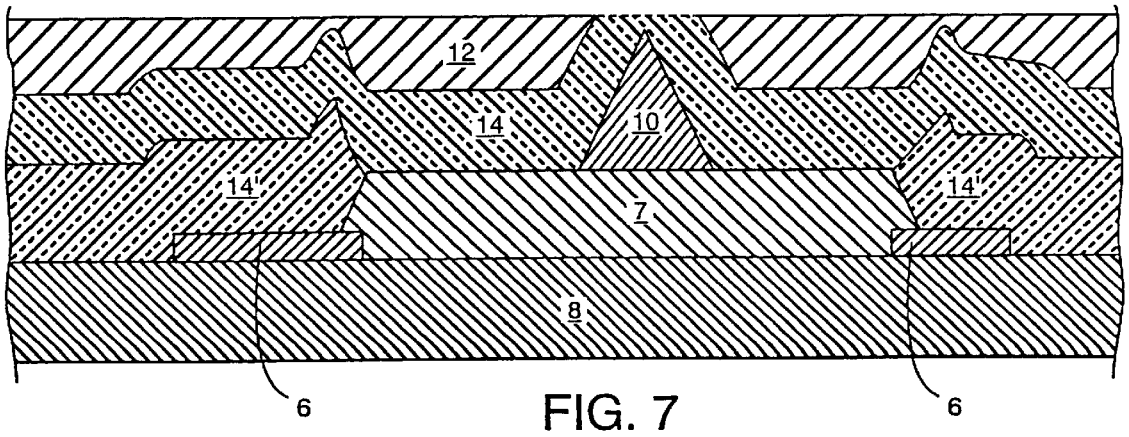
FIG. 7 illustrates the results of a final step in the production of a base assembly for a flat panel field emission display in accordance with an exemplary implementation of the present invention.

The resulting arrangement prior to mechanical planarization is illustrated in FIG. 6. If desired, a thin film layer suitable for use as a buffer for a chemical mechanical planarization may be deposited on top of the grid electrode. The provision of such a buffer is discussed in the aforementioned patents to Doan et al. A mechanical planarization such as chemical-mechanical planarization is then performed to produce a planarized base assembly, as illustrated in FIG. 7. After formation and mechanical planarization of the base assembly, columnar supports 16 and a screen are assembled to produce a flat panel field emission device such as those illustrated in FIGS. 1–3.

Thus, an improved base assembly for use with a flat panel field emission device may include a dielectric spacer layer such as silicon dioxide which has been deposited to a thickness approximately equal to the average thickness of the exposed resistor layer above the base conductor of the field emission display base assembly. Photolithographic patterning of the spacer thin film layer can be used to expose portions of the film deposited on areas of the base assembly where it is not desired, which are then removed through etch processing. The photoresist is stripped and a grid electrode conductive layer is deposited. A mechanical planarization technique such as chemical-mechanical planarization may then be used to further planarize the base assembly.

Although the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A planarized base assembly for use in a flat panel display comprising:

a base;

a first conductive layer formed over first portions of said base;

a resistive layer formed over second portions of said base, said second portions overlapping said first portions at least in part, said resistive layer having an approximate average thickness d;

a first insulative layer formed over third portions of said base, said first insulative layer being substantially non-overlapping relative to said resistive layer, said first insulative layer having an approximate average thickness substantially equal to the approximate average thickness d of said resistive layer; and a second insulative layer formed over substantially all of said first portions, said second portions and said third portions.

2. The base assembly of claim 1, further including an array of field emitters formed on top of said resistive layer.

3. The base assembly of claim 2, further including a second conductive layer formed over said second insulative layer with openings formed at the locations of the emitters of said array of field emitters.

4. The base assembly of claim 3, wherein said second conductive layer is formed from doped polycrystalline silicon.

5. The base assembly of claim 3, wherein said base, said conductive layer, said resistive layer, said first insulative layer, said second insulative layer, said array of field emitters, and said second conductive layer form a base assembly of a flat panel field emission display.

6. The base assembly of claim 1, wherein said conductive layer has a thickness less than the approximate thickness d of said resistive layer.

7. The base assembly of claim 6, wherein said approximate thickness d of said resistive layer is approximately 7 K Å.

8. The base assembly of claim 7, wherein said second insulative layer has an approximate thickness of 6 K Å.

9. The base assembly of claim 1, wherein said first conductive layer is formed at least in part from chromium.

10. The base assembly of claim 1, wherein said first conductive layer is formed at least in part from doped polycrystalline silicon.

11. The base assembly of claim 1, wherein said resistive layer is formed from silicon.

12. The base assembly of claim 1, wherein said first and second insulative layers are formed from silicon dioxide.

13. A flat panel display comprising:

a base;

a conductor array formed on said base;

a plurality of electron emission tips arranged in a matrix over said base;

a pattern of resistive material which separates said electron emission tips from corresponding portions of said conductor array; said resistive material having a top surface spaced from said base;

a spacer of an insulating material arranged in openings formed by said pattern of resistive material, said spacer having a top surface which is generally coincident with the top surface of said resistive material;

an insulating layer arranged over said pattern of resistive material and said spacer and having openings at the locations of said electron emission tips;

a conductive material provided over said insulating layer and having openings at the locations of said electron emission tips; and a phosphor coated screen spaced from said conductive material provided over said insulating layer.

14. The flat panel display of claim 13, wherein said conductor array is addressable by row signals.

15. The flat panel display of claim 14, wherein said conductor array is further addressable by column signals.

16. The flat panel display of claim 13, wherein said conductor array is formed at least in part from chromium.

17. The flat panel display of claim 13 wherein said conductor array is formed at least in part from doped polycrystalline silicon.

18. The flat panel display of claim 13, wherein said spacer is a patterned layer of silicon dioxide.

19. The flat panel display of claim 13, wherein said conductive material provided over said insulating layer is doped polycrystalline silicon.

20. The flat panel display of claim 13, further including a plurality of columnar supports which separate said phosphor coated screen from said conductive material provided over said insulating layer.

21. The flat panel display of claim 13, wherein said conductive material provided over said insulating layer is a grid electrode.

22. The flat panel display of claim 21, wherein said grid electrode is continuous.

23. The flat panel display of claim 21, wherein said grid electrode includes a plurality of addressable column portions.

24. A substantially planar assembly for use in a flat panel field emission display, said planar assembly comprising:

a first conductive layer selectively formed over first portions of a base;

a resistive layer formed over second portions of said base such that said second portions overlap said first portions at least in part, said resistive layer having a substantially uniform average thickness;

an electrically insulative spacer formed over third portions of said base such that said third portions are substantially non-overlapping relative to said resistive layer, said electrically insulative spacer having a substantially uniform average thickness approximately equal to the average thickness of said resistive layer;

an electrically insulative layer formed over substantially all of said first portions, said second portions and said third portions; and a second conductive layer provided over said electrically insulative layer, wherein said second conductive layer has been subjected to mechanical planarization.

25. The substantially planar assembly of claim 24, wherein said electrically insulative spacer is a patterned layer of silicon dioxide.

26. The substantially planar assembly of claim 24, wherein said second conductive layer, following mechanical planarization, is a grid electrode for a flat panel field emission display.

27. The substantially planar assembly of claim 24, further comprising an array of field emitters formed on top of said resistive layer and wherein said second conductive layer includes openings formed at the locations of said field emitters.

28. The substantially planar assembly of claim 24, wherein said first conductive layer is formed from chromium.

29. The substantially planar assembly of claim 24, wherein said first conductive layer is formed from polycrystalline silicon.

30. The substantially planar assembly of claim 24, wherein said resistive layer is formed from silicon.

31. A base assembly for a flat panel display, comprising:

a base;

a conductor array formed on said base;

a plurality of electron emission tips arranged in a matrix over said base;

a pattern of resistive material which separates said electron emission tips from corresponding portions of said conductor array, said resistive material having a top surface spaced from said base;

a spacer of insulating material arranged in openings formed by said pattern of resistive material, said spacer having a top surface which is generally coincident with the top surface of said resistive material;

an insulating layer arranged over said pattern of resistive material and said spacer and having openings at the locations of said electron emission tips; and a conductive material provided over said insulating layer and having openings at the locations of said electron emission tips.

32. The base assembly of claim 31, wherein said conductor array is addressable by row and/or column signals.

33. The base assembly of claim 31, wherein said spacer is a patterned layer of silicon dioxide.

34. The base assembly of claim 31, wherein said conductive material provided over said insulating layer is a grid electrode.

* * * * *